US007013587B2

(12) United States Patent
Yama

(10) Patent No.: US 7,013,587 B2
(45) Date of Patent: Mar. 21, 2006

(54) FOOTWEAR WEAR EXCHANGEABLE UPPER AND SOLE PORTIONS

(75) Inventor: Hiromitsu Yama, 9-23, Minami Midorimachi, Mizushima, Kurashiki-shi, Okayama (JP) 712-8023

(73) Assignees: Hiromitsu Yama, Okayama (JP); Masaki Yamashita, Okayama (JP)

( * ) Notice: Subject to any disclaimer, the term of this patent is extended or adjusted under 35 U.S.C. 154(b) by 32 days.

(21) Appl. No.: 10/488,740

(22) PCT Filed: Sep. 17, 2002

(86) PCT No.: PCT/JP02/09498

§ 371 (c)(1),
(2), (4) Date: Mar. 5, 2004

(87) PCT Pub. No.: WO03/024262

PCT Pub. Date: Mar. 27, 2003

(65) Prior Publication Data

US 2004/0231197 A1 Nov. 25, 2004

(30) Foreign Application Priority Data

Sep. 18, 2001 (JP) ..... 2001-283813

(51) Int. Cl.
*A43B 3/24* (2006.01)

(52) U.S. Cl. ..... 36/101

(58) Field of Classification Search ..... 36/101, 36/100, 15

See application file for complete search history.

(56) References Cited

U.S. PATENT DOCUMENTS

| | | | | | |
|---|---|---|---|---|---|
| 2,200,080 | A | * | 5/1940 | Fein | 36/101 |
| 2,261,125 | A | * | 11/1941 | McFeely | 36/101 |
| 2,302,596 | A | * | 11/1942 | Bigio | 36/101 |
| 2,430,338 | A | * | 11/1947 | Heiman | 36/12 |
| 2,491,930 | A | * | 12/1949 | Parlante | 36/101 |
| 2,493,154 | A | * | 1/1950 | Mavrakis | 36/101 |
| 4,103,440 | A | * | 8/1978 | Lawrence | 36/101 |
| 4,745,693 | A | * | 5/1988 | Brown | 36/101 |
| 5,983,528 | A | * | 11/1999 | Hartung | 36/15 |
| 2004/0231197 | A1 | * | 11/2004 | Yama | 36/101 |

FOREIGN PATENT DOCUMENTS

| | | |
|---|---|---|
| JP | 61-187801 | 8/1986 |

* cited by examiner

*Primary Examiner*—Ted Kavanaugh
(74) *Attorney, Agent, or Firm*—Koda & Androlia

(57) ABSTRACT

Footwear characterized by comprising an upper portion (1), a shoe sole (2), and a fastener (3) that connects them, wherein a plurality of kinds of upper portions are exchangeably used by being connected by the fastener (3) with respect to the shoe sole that is made the basis. The footwear is arranged so that the shoe sole (2) is used by being connected by the fastener in such a manner that the kind of the upper portion is changed according to the purpose of use of the shoe. A cover depending from the upper portion or a cover (7) rising from the shoe sole covers the fastener; the fastener is a slide fastener encircling the shoe except the heel of the shoe sole; and the initial end and a portion adjacent the terminal end of the fastener (3) encircling the shoe sole (2) meet each other.

5 Claims, 8 Drawing Sheets

FOOTWEAR WEAR EXCHANGEABLE UPPER AND SOLE PORTIONS

This application is a 371 of PCT/JP02/09498 filed Sep. 17, 2002.

TECHNICAL FIELD

The present invention relates to footwear, in which both of an upper portion and a shoe sole are exchangeably used.

BACKGROUND ART

In sports shoes, sneakers, overshoes, boots, saddle shoes and the like, an upper portion made of cloth or synthetic resin and a shoe sole made of synthetic resin, rubber or leather are completely integrated with each other by sewing or gluing. In particular, it has been considered that the sewing or gluing technique is important in order to enhance strength, durability and the like of the shoes.

In shoes hitherto, an upper portion and a shoe sole have been integrated with each other; therefore, they could not be separated from each other. As a consequence, if either one of the upper portion and the shoe sole has been broken, the shoes as a whole is to be disposed or left in a shop or the like for repair, so that the shoes could not be used. Furthermore, in the case where shoes are limited to use at only indoors or outdoors, a user must prepare a pair of substituted shoes and change the shoes when he or she moves from that location. Moreover, various designed shoes full of variety have been commercially available in recent years, and it is general for the user to select ones of his or her shoes and change them in accordance with circumstances. Accordingly, if only the upper portion could be separated from the shoe sole and exchanged with another upper portion, storage spaces of the shoes can be saved since that the number of bulky shoe soles (which is solid and cannot be folded) can be reduced more than that of the upper portions, and that the shoes as a whole are not bulky; thereby providing convenience. However, such shoes as described above have not been found. Thus, the inventor of the present invention has studied the footwear in which both of an upper portion and a shoe sole are exchangeably used.

DISCLOSURE OF THE INVENTION

As a result of the study, the above-described problems can be solved by providing the footwear characterized by an upper portion, a shoe sole and a fastener that connects the upper portion and the shoe sole together. That is, there is provided footwear wherein a plurality of kinds of the upper portions are exchangeably used by being connected by the fastener with respect to the shoe sole that is made the basis. As a consequence, the footwear of which a user exchangeably uses the upper portion while wearing can be provided. As to the fastener, it can be adopted by hook & loop type fastener made of cloth, dot buttons or the like in addition to a slide fastener. In particular, the slide fastener is preferable from the viewpoint of strength and operability. Moreover, the upper portion herein is not limited only to a type which covers the entire instep of a foot, but a toe portion may be opened like sandals.

Additionally, there is provided footwear wherein the shoe sole is used by being connected by the fastener in such a manner that the kind of the shoe sole is changed according to the purpose of use of the shoe with respect to the upper portion that is made the basis. A shoe sole is special in shoes for, for example, roller skating, ice skating, ice hockey or the like. According to the present invention, a user can move from the place if only the shoe sole is exchanged while the upper portion remains as it is after the use in playing those sports.

To avoid any damage or accident from the fastener, as well as to achieve sophisticated design of the shoes, the fastener is preferably covered with a cover material (a skirt) depending from the upper portion, a cover material rising from the shoe sole, or both of the cover materials.

In addition, the fastener formed in such a manner that is encircling the shoe except a heel of the shoe sole is convenient since a piece which is remained at the upper portion of the heel is grasped by one hand while a slider of the fastener is easily operated by the other hand when the fastener is attached or detached.

In an example that the fastener is a slide fastener, the fastener meets portions adjacent the initial end and the terminal end of the fastener encircling the shoe sole each other. Consequently, it is unnecessary to remain a part of the heel of the footwear, so that the upper portion can be produced as a unit at the entire circumference. Even if the initial end and the terminal end are formed in one, the slider can be readily attached or detached with a flexible tape made of cloth. Furthermore, it makes the design of the shoes excellent.

BEST MODE FOR CARRYING OUT THE INVENTION

Figure 1:
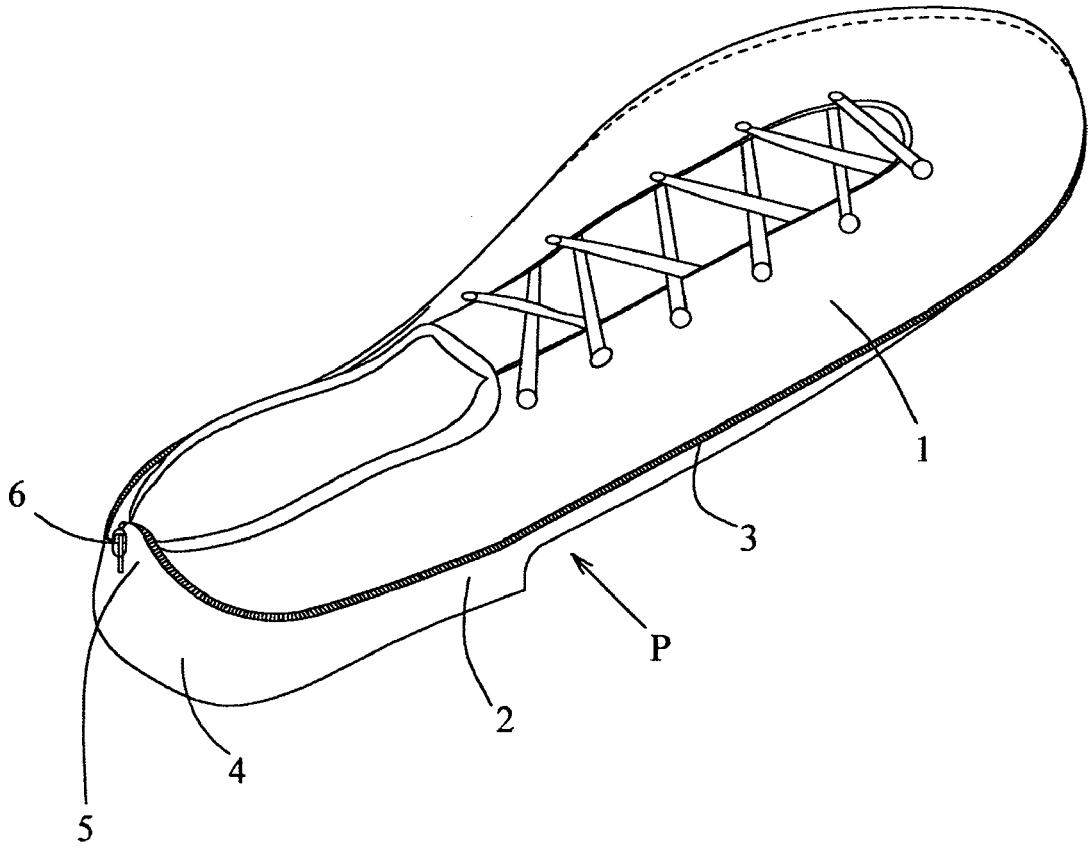
FIG. 1 is a perspective view showing a sports shoe in a preferred embodiment of footwear according to the present invention.
Figure 2:
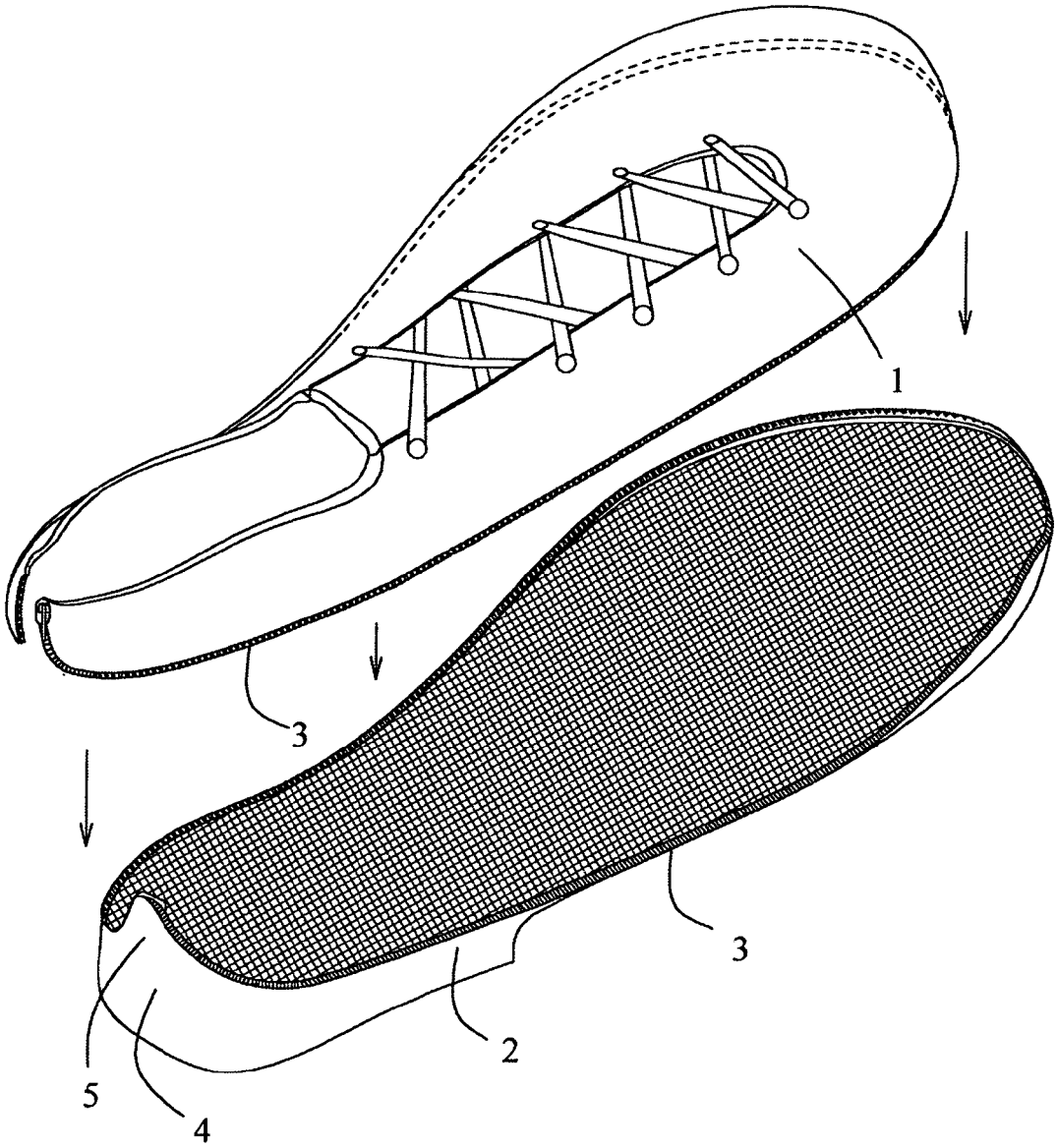
FIG. 2 is an exploded perspective view showing the shoe.
Figure 3:
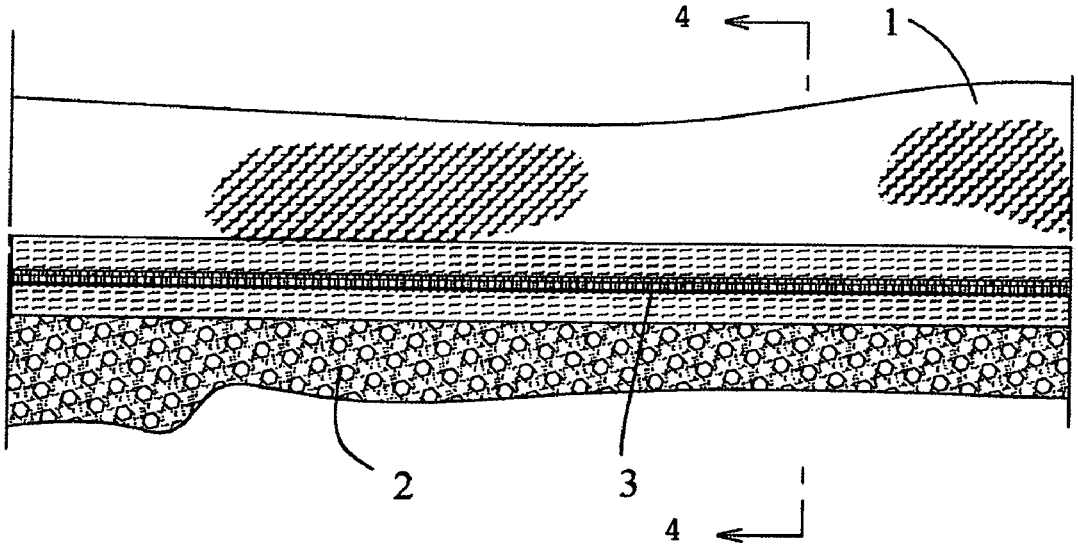
FIG. 3 is an enlarged side view showing a portion designated by reference character P in FIG. 1.

As is clear from FIGS. 1 to 3, footwear according to the embodiment comprises that an upper portion 1 and a shoe sole 2 are connected together via a fastener 3. The fastener 3 in this embodiment is a slide fastener. The fastener 3 encircles the footwear except a heel 4 of the shoe sole 2, so that a piece 5 is grasped by one hand while a slider 6 of the fastener is operated by the other hand when the fastener 3 is operated, and thereby the upper portion 1 can be exchanged as a foot remains put on the shoe sole 2. To the contrary, in the cases where the shoe sole 2 is to be dried or sterilized with ultraviolet rays, only the shoe sole 2 is exchanged with a dried or sterilized shoe sole or a shoe sole which satisfies the purpose of use, so that the upper portion 1 can be continuously used. Backing covers adjusting at center of the rear portion of the upper portion 1 from a side or both sides thereof are preferably adopted, so as to prevent the slider 6 from contacting directly with a skin or being shifted during walking.

Figure 4:
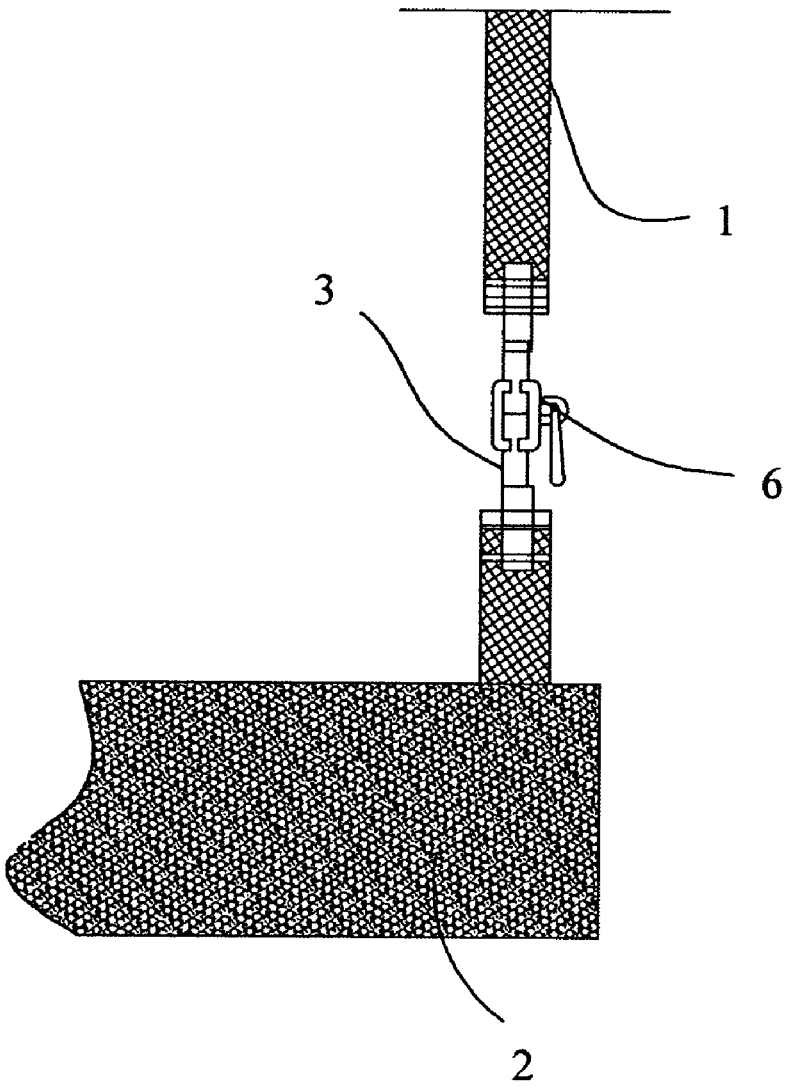
FIG. 4 is a cross-sectional view taken along line 4—4 in FIG. 3.
Figure 5:
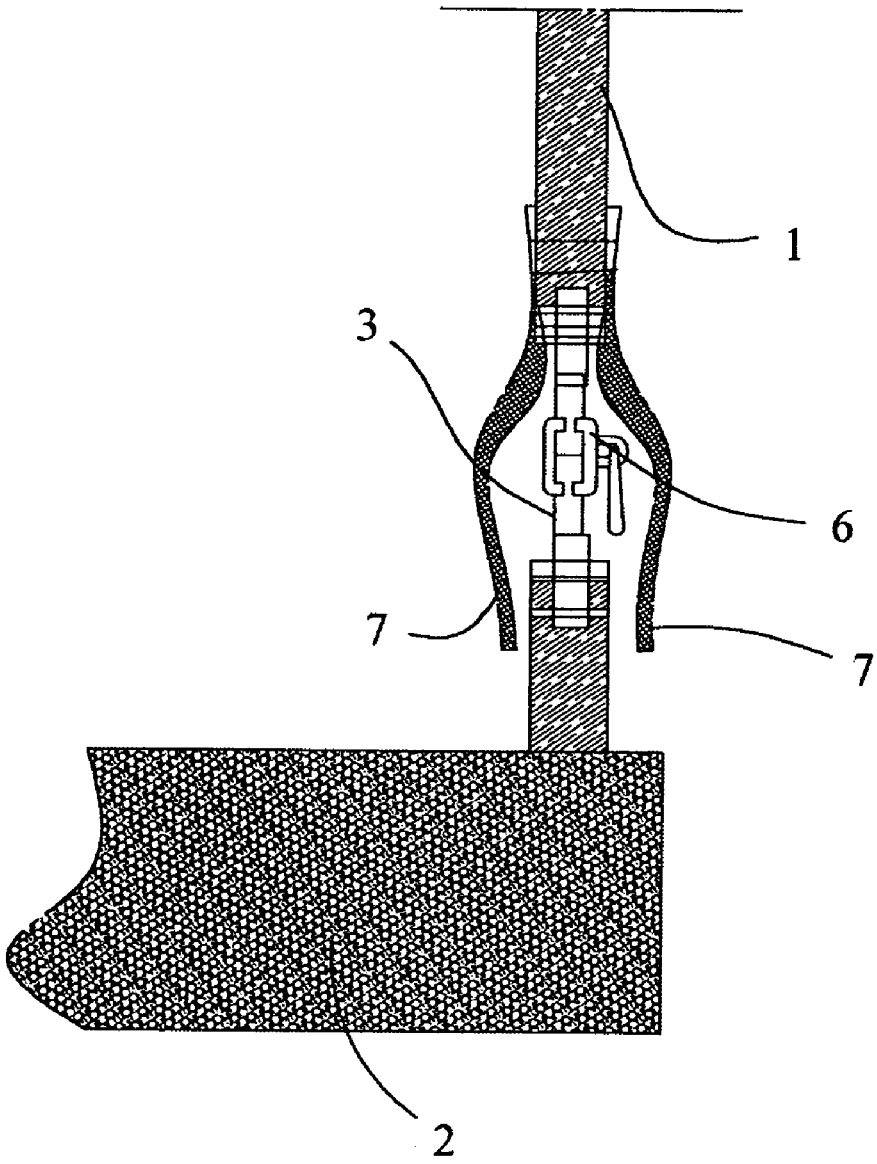
FIG. 5 is a cross-sectional view showing an example, in which a cover material depends from an upper portion, corresponding to FIG. 4.
Figure 6:
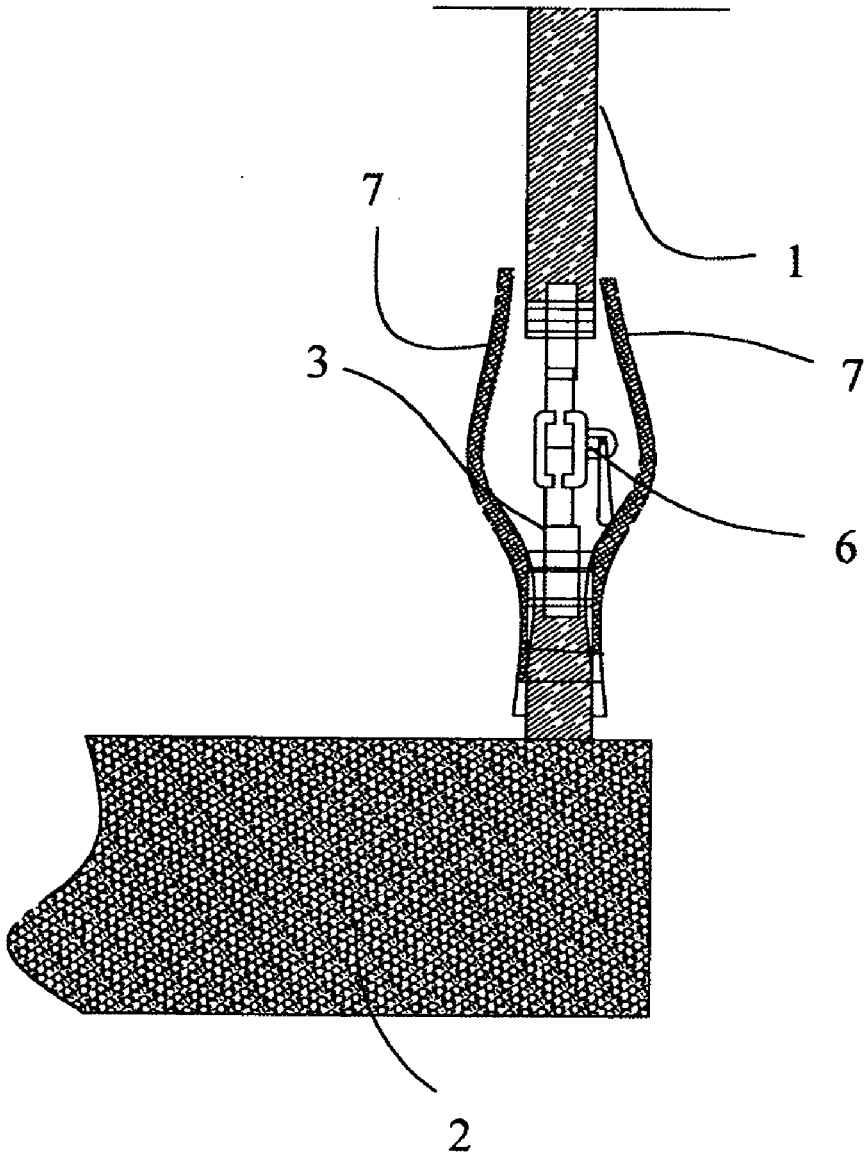
FIG. 6 is a cross-sectional view showing an example, in which a cover material rises from a shoe sole, corresponding to FIG. 4.

FIG. 4 is a cross-sectional view taken along line 4—4 in FIG. 3, in which the fastener 3 is exposed to the outside. In this manner, the fastener 3 may be exposed in a design in which the fastener 3 is emphasized. In contrast, FIGS. 5 and 6 show structures in which the fastener 3 or the slider 6 is prevented from contacting directly with a foot or a sock, and which the fastener 3 or the slider 6 is concealed in view of a design. FIG. 5 shows an example in which covers 7 and 7 depend from the upper portion 1. Furthermore, FIG. 6 shows an example in which the covers 7 and 7 rise from the shoe sole 2. Although the covers 7 and 7 are arranged at both of an inner surface and an outer surface of the footwear, the cover 7 may be arranged only at either one surface. Moreover, the cover 7 may be partly arranged in such a manner as to conceal only the end portions of the fastener.

Figure 7:
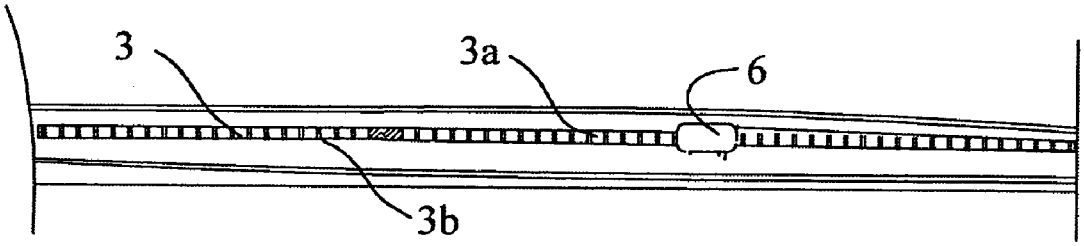
FIG. 7 is a plan view showing essential parts in a structure in which a fastener encircles the entire circumference in the vicinity of the shoe sole.

One of modes in which the upper portion 1 and the shoe sole 2 are connected together via the fastener 3 is exemplified in a structure in which the fastener 3 encircles the entire circumference in the vicinity of the shoe sole 2. FIG. 7 is a plan view showing essential parts in this case. By employing the structure in which the fastener 3 encircling the vicinity of the shoe sole 2 meets portions adjacent an initial end 3*a* and a terminal end 3*b* each other, and further, in which the fastener encircling the upper portion 1 meets the both ends thereof each other to be thus inserted at one of the ends thereof into the slider 6, teeth (i.e., elements) of the fastener can be easily inserted into the slider 6 at an early stage when the upper portion 1 and the shoe sole 2 are connected together, thereby facilitating the connection. A slide fastener having small elements, such as elements for clothes, may be used so as to prevent the fastener from being exposed, as possible.

Although the footwear illustrated in the above preferred embodiment is directed to sports shoes, the present invention can be embodied by shoes for sneakers, overshoes, boots, saddle shoes and sandals. Further, it can be embodied by shoes for roller skating, ice skating and ice hockey and the like. Moreover, the present invention can be applied also to a tabi by disposing a fastener at a bifurcated portion near an instep of a foot.

Figure 8:
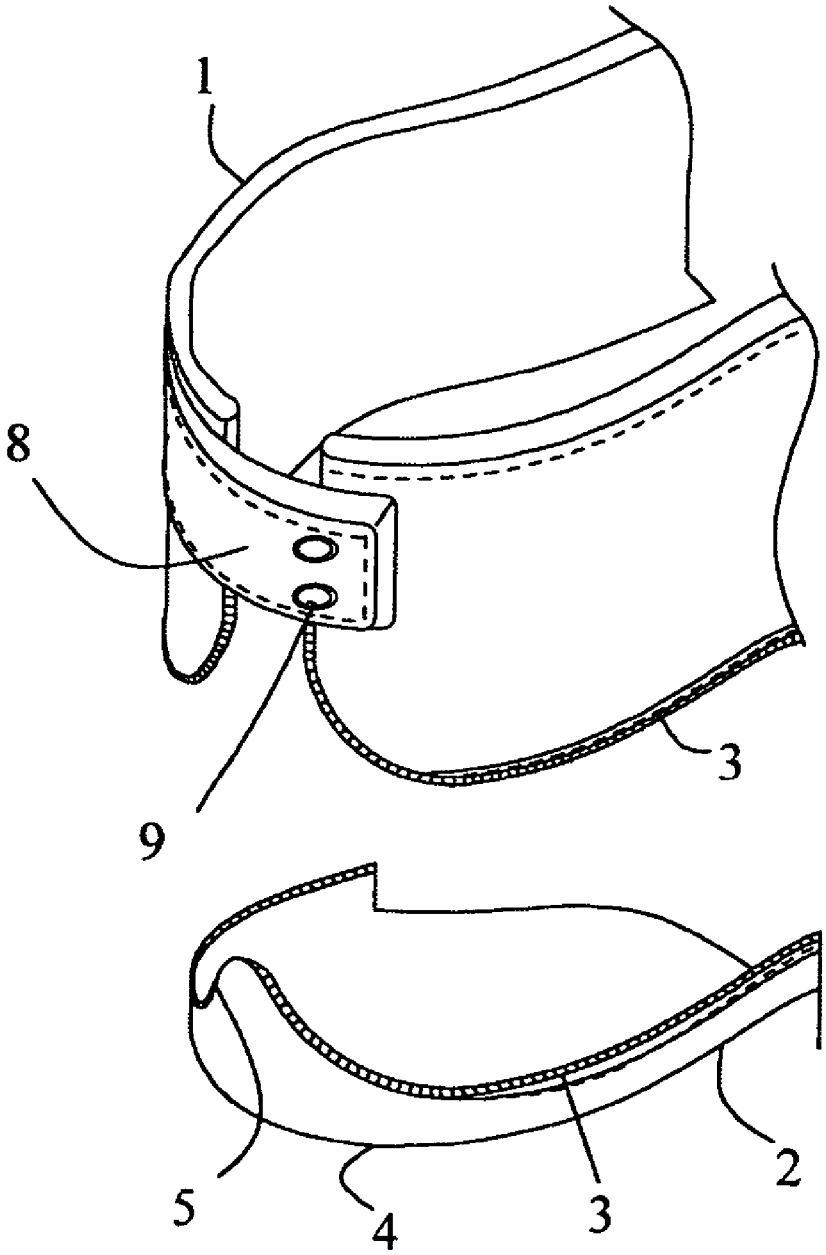
FIG. 8 is an exploded perspective view showing essential parts in the case where a heel at the upper portion is high in the preferred embodiment of the footwear according to the present invention.

FIG. 8 shows an example where a heel at the upper portion 1 is high. In this case, a fastener covering piece 8 is provided at an upper portion, thereby preventing the elements of the fastener 3 or the slider 6 from being exposed at the upper portion of the heel and contacting directly with a foot, so as to eliminate pain. If a dot button 9 or a hook & loop fastener is arranged in the vicinity of the tip of the fastener covering piece 8, the upper portion of the heel can be prevented from being opened even in the case of that the upper portion of the heel is high at the upper portion 1. Otherwise, a cover having a structure for covering the heel from an upper inner surface thereof to the entire outside surface thereof may be used as a cover for preventing the upper portion of the heel from being opened. There can be conceived shoes having the upper portion 1 higher than the piece 5, like basket shoes. Additionally, there can be conceived shoes in which the piece 5 consists of the initial end and the terminal end of the slide fastener 3.

INDUSTRIAL APPLICABILITY

The footwear according to the present invention has advantages in that the detached upper portion can be easily washed by a washing machine, and can be promptly dried. Since the upper portion and the shoe sole are separated from each other and are connected together via the fastener, only a broken upper portion or a broken shoe sole can be disposed or repaired in the case where either one of the upper portion and the shoe sole is broken. Therefore, the footwear according to the present invention can be continuously used by exchanging the broken portion. Moreover, the footwear according to the present invention has an advantage that a user need not be changed the whole shoes utilizing by simply exchanging either one of the upper portion and the shoe sole in the case where he or she must change the shoes in order to move to another place. Consequently, the user can respond to various situations adequately by exchanging only the shoe sole if the user carries a plurality of shoe soles. In addition, needs can be met with ease by exchanging the upper portions full of variety, which are variously designed, have various patterns or are made of various materials (e.g., fabric, leather and synthetic leather). It is not only convenient since the above-described shoes can reduce the space occupied even when the user carries the shoes, but also adaptable with variations in weather. As described above, according to the present invention, the footwear that can be used in various manners only by exchanging either one of the upper portion and the shoe sole can be provided.

What is claimed is:

1. Footwear comprising:

an upper portion (1);

a shoe sole (2);

a sliding fastener (3) that connects the upper portion (1) and the shoe sole (2) detachably together;

a cover member (7) entirely covering said sliding fastener; and an upwardly projecting portion (5) provided on said shoe sole at a heel of said shoe sole; and wherein said sliding fastener extends down one side of said upwardly projecting portion, around the shoe sole and up another side of the upwardly projecting portion to couple together said shoe sole and said upper portion.

2. Footwear according to claim 1, further comprising a plurality of kinds of the upper portions (1) that are exchangeably connected by the sliding fastener (3) to the shoe sole (2).

3. Footwear according to claim 1, wherein said cover member (7) is coupled to and extends upwardly from the shoe sole (2).

4. Footwear according to claim 1 wherein said cover member (7) is coupled to and extends downwardly from said upper portion (1).

5. Footwear according to claim 3 or 4 wherein said cover member (7) covers both an outer and an inner side of said sliding fastener (3).

* * * * *

UNITED STATES PATENT AND TRADEMARK OFFICE

CERTIFICATE OF CORRECTION

PATENT NO. : 7,013,587 B2
APPLICATION NO. : 10/488740
DATED : March 21, 2006
INVENTOR(S) : Hiromitsu Yama It is certified that error appears in the above-identified patent and that said Letters Patent is hereby corrected as shown below:

Titke page, and Column 1:
Item [54] Title of Invention:

Change "Footwear Wear Exchangeable Upper and Sole Portions" to --FOOTWEAR WITH EXCHANGEABLE UPPER AND SOLE PORTIONS--

Signed and Sealed this

Fourteenth Day of August, 2007

JON W. DUDAS
*Director of the United States Patent and Trademark Office*